US006053022A

United States Patent [19]

Shore

[11] Patent Number: 6,053,022

[45] Date of Patent: Apr. 25, 2000

[54] MODULAR ROLLING MILL

[75] Inventor: T. Michael Shore, Princeton, Mass.

[73] Assignee: Morgan Construction Company, Worcester, Mass.

[21] Appl. No.: 09/152,950

[22] Filed: Sep. 14, 1998

[51] Int. Cl.[7] ..... B21B 31/07; B21B 13/12; B21B 35/00

[52] U.S. Cl. ..... 72/249; 72/235; 72/238

[58] Field of Search ..... 72/249, 250, 251, 72/239, 235, 234, 238

[56] References Cited

U.S. PATENT DOCUMENTS 3,665,746 5/1972 Eibe ..... 72/239
3,765,212 10/1973 Moslener ..... 72/249
5,144,828 9/1992 Grotepass et al. ..... 72/235
5,595,083 1/1997 Shore ..... 72/249

*Primary Examiner*—Joseph J. Hail, III
*Assistant Examiner*—Rodney Butler
*Attorney, Agent, or Firm*—Samuels, Gauthier & Stevens

[57] ABSTRACT

In a modular rolling mill gear units are installed between selected rolling units in place of other rolling units which haven removed from the mill pass line to thereby provide a gap in the rolling sequence. Each gear unit is coupled to the drive units previously coupled to the respective removed rolling unit, and is configured to provide a continuation of the mill drive train end to accommodate operation of the next subsequent rolling unit at the speed of the respective removed rolling unit. The gear units carry water boxes or other equivalent cooling devices which serve to lower the temperature of the product between successive roll passes.

2 Claims, 4 Drawing Sheets

MODULAR ROLLING MILL

BACKGROUND OF THE INVENTION

1. Field of the Invention

This invention relates to single strand modular rolling mills for rolling long products such as bars, rods and the like.

2. Description of the Prior Art

With reference initially to FIG. 1, a known modular rolling mill of the type described in the commonly assigned U.S. Pat. No. 5,595,083 is shown comprising at least three, and in this case, five rolling units $RU_1$–$RU_5$ arranged in succession on a mill pass line $P_L$. Each rolling unit has multiple pairs of work rolls 10*a*, 10*b*. The work rolls may be sized and grooved to provide a typical oval-round pass sequence, with successive roll pairs being offset by 90° to effect a twist-free rolling sequence on a product being directed along the mill pass line.

Except for the size and/or groove configuration of the work rolls, the rolling units are identical and interchangeable one for the other at any location along the mill pass line. With reference to FIG. 2, which is a diagrammatic illustration of the internal drive components of a typical rolling unit, it will be seen that the work rolls 10*a* are mounted in cantilever fashion on the ends of roll shafts 12 rotatably supported by bearings 14. Gears 16 on the roll shafts mesh with intermeshed intermediate drive gears 18, the latter being carried on intermediate drive shafts 20 journalled for rotation between bearings 22. The work rolls 10*b* are mounted and driven by mirror image components identified by the same reference numerals. One of each pair of intermediate drive shafts 20 is additionally provided with a bevel gear 24 meshing with a bevel gear 26 on an input shaft 28. The input shafts 28 protrude from a "drive side" of the rolling unit where they terminate in coupling halves 30*a*.

The two input shafts are additionally provided with gears 32 which mesh with a larger diameter intermediate gear 34. It will thus be seen that the work roll pairs 10*a*, 10*b* of each rolling unit are mechanically interconnected as a result of the interengagment between the gears 32 on the input shafts 28 and the intermediate gear 34.

Returning to FIG. 1, it will be seen that drive units $DU_1$–$DU_4$ are arranged in succession alongside the mill pass line PL. Each drive unit includes a gear box 36 driven by a drive motor 38. The gear boxes have gear connected output shafts 40 terminating in coupling halves 30*b*. It will be understood that the coupling halves 30*a* on the input shafts 28 of the rolling units are designed to mate with the coupling halves 30*b* on the output shafts 40 of the gear boxes 36 to provide readily separable drive connections, thereby accommodating ready engagement and disengagement of the rolling units from the drive units. The input shafts 28 of each of the rolling units $RU_2$, $RU_3$, $RU_4$, i.e., all but the first and last rolling units, are coupled to the output shafts 40 of two successive drive units $DU_1$–$DU_4$. The first and last rolling units $RU_1$, $RU_5$ are coupled respectively and exclusively to the first and last drive units $DU_1$, $DU_5$.

It will thus be seen that the drive units $DU_1$–$DU_4$ are coupled one to the other via the internal drive components of the rolling units $RU_1$–$RU_5$ to thereby provide a continuous drive train from one end to the other of the modular mill. With this arrangement, as the front end of a product enters each successive roll pass, the resulting momentary speed decrease is transmitted throughout all of the rolling units, thereby making it possible to maintain substantially constant interstand product tension in a self regulating manner without resort to external controls. This continuous drive train drives the successive work roll pairs at progressively higher speeds as depicted graphically in FIG. 3.

Modular rolling mills of the above described type are widely used to roll low, medium, high carbon and low alloy steel products, where the heat build-up between roll pairs is relatively modest. For example, when rolling a 16.8 mm process section into a 5.5 mm rod at delivery speeds of 100 m/sec, heat build-up between the first and last roll pairs of the modular mill is likely to be on the order of 100 to 150° C. However, more exotic products, e.g., nickel based alloys, high speed steels, waspalloys, etc. cannot tolerate such temperature increases. Since there is insufficient space between the rolling units to accommodate sufficient water cooling, up to now one option has been to substitute water boxes for selected rolling units. While this provides added cooling, it does so by sacrificing the continuity of the drive train.

Another option has been to reduce the rolling speed of the mill in order to reduce energy build up in the product being rolled. This too is unsatisfactory because it results in a reduction in the output of the mill. Lower temperature thermomechanical rolling has also been difficult to achieve, again due to the inability to introduce adequate cooling between the successive rolling units.

The objective of the present invention is to provide a gap in the rolling sequence of the modular mill in order to accommodate the introduction of additional cooling, without interrupting the continuity of the drive train.

SUMMARY OF THE INVENTION

In accordance with the present invention, gear units are installed between selected rolling units in place of other rolling units which have been "dummied", i.e., removed from the mill pass line to thereby provide a gap in the rolling sequence. Each gear unit is coupled to the drive units previously coupled to the respective dummied rolling unit, and is configured to provide a continuation of the mill drive train end to accommodate operation of the next subsequent rolling unit at the speed of the respective dummied rolling unit. The gear units carry water boxes or other equivalent cooling devices which serve to lower the temperature of to the product between successive roll passes.

These and other objects and advantages of the present invention will now be described in greater detail with additional reference to the accompanying drawings, wherein:

DETAILED DESCRIPTION OF PREFERRED EMBODIMENT

Figure 5:
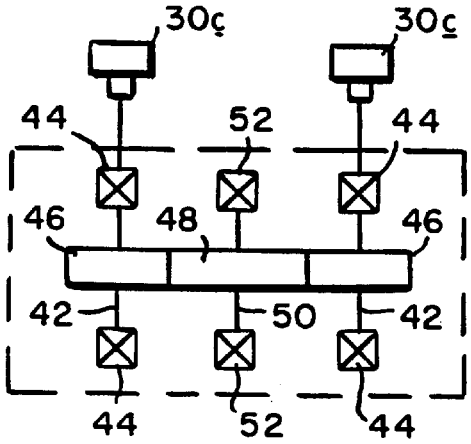
FIG. 5 is a diagrammatic illustration of the internal components of a typical gear unit.
Figure 6:
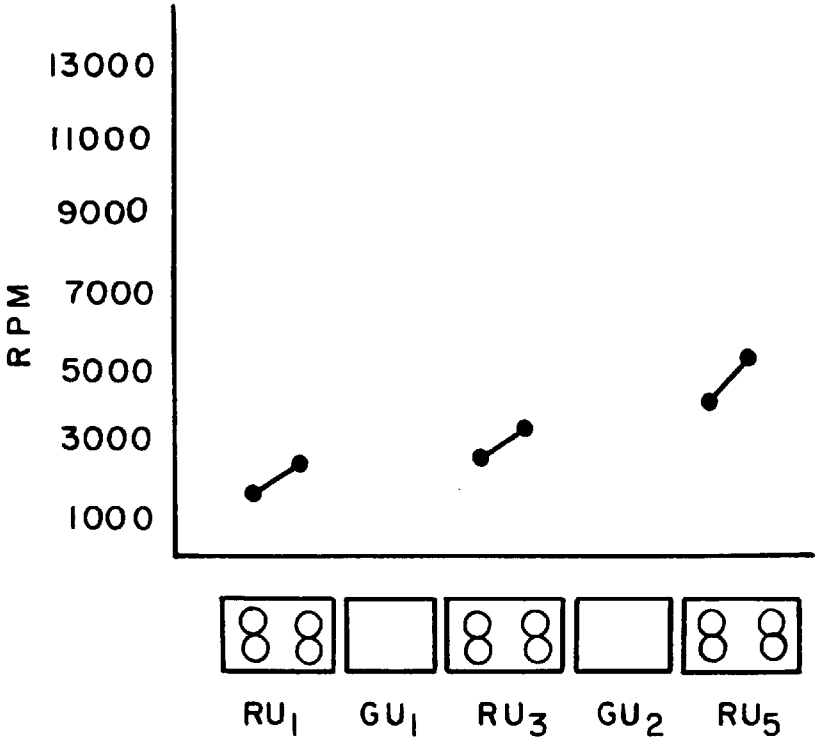
FIG. 6 is a graph depicting the speed relationship between the successive roll pairs of the modular rolling mill depicted in FIG. 4.
Figure 4:
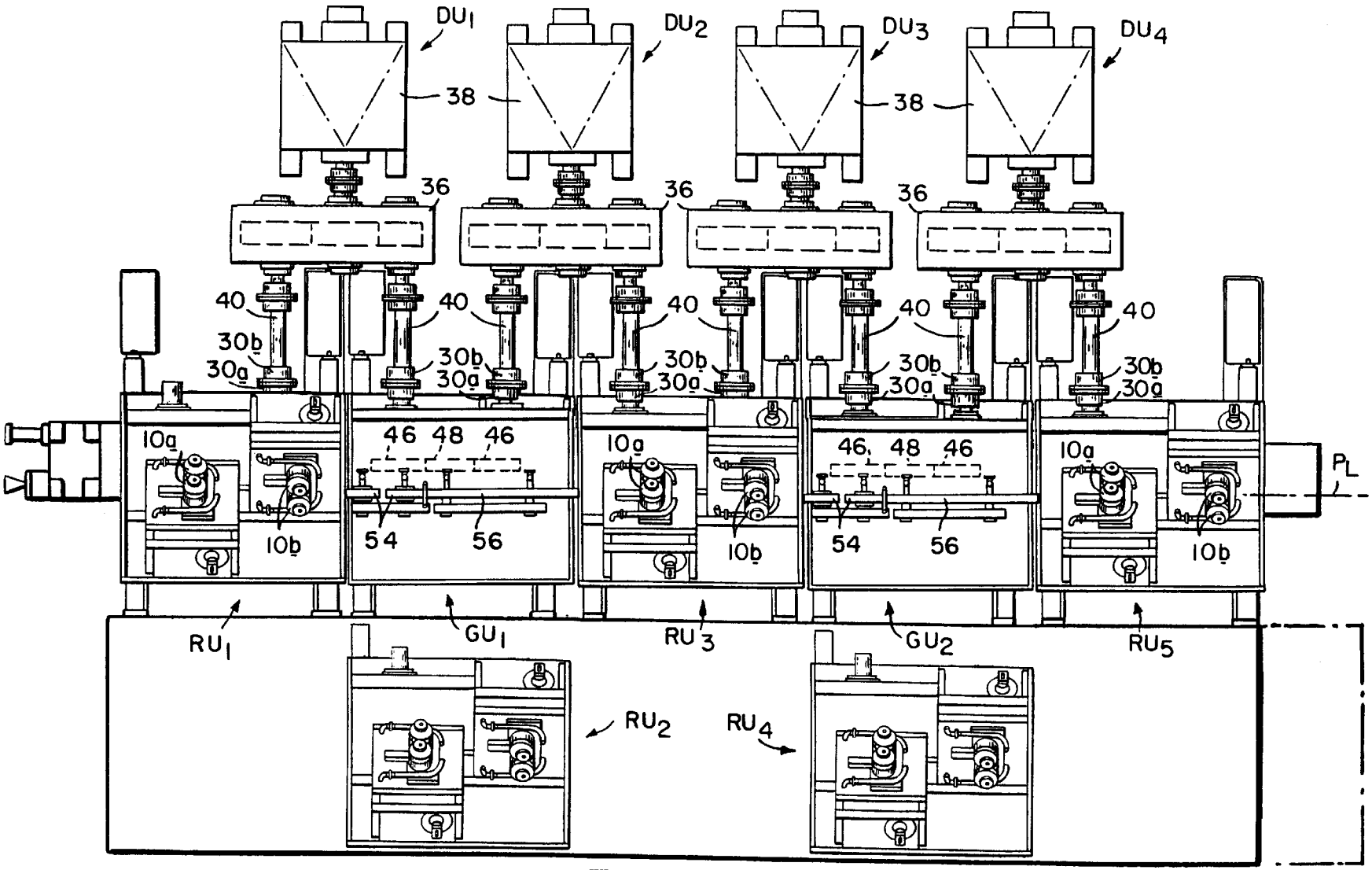
FIG. 4 is a view similar to FIG. 1 showing the modular rolling mill with gear units interposed between selected rolling units in accordance with the present invention.

In accordance with the present invention, as shown in FIGS. 4–6, gear units $GU_1$, $GU_2$ are installed along the mill pass line $P_L$ in place of dummied rolling units $RU_2$, $RU_4$, the latter having been displaced laterally from the mill pass line PL to the "work side" of the mill. As can best be seen in FIG. 5, each gear unit includes input shafts 42 rotatably supported by bearings 44. The input shafts 42 carry gears 46 which mesh with a central gear 48 carried on an intermediate shaft 50 also rotatably supported by bearings 52. The shafts have protruding ends terminating in coupling halves 30*c*.

The coupling halves 30*c* are adapted to mate with the coupling halves 30*b* of the drive units that were previously coupled to the dummied rolling units. The gear trains 46, 48, 46 of the gear units replace the gear trains of the dummied rolling units, thereby accommodating gaps in the rolling sequence without interrupting the overall drive train of the mill.

Figure 3:
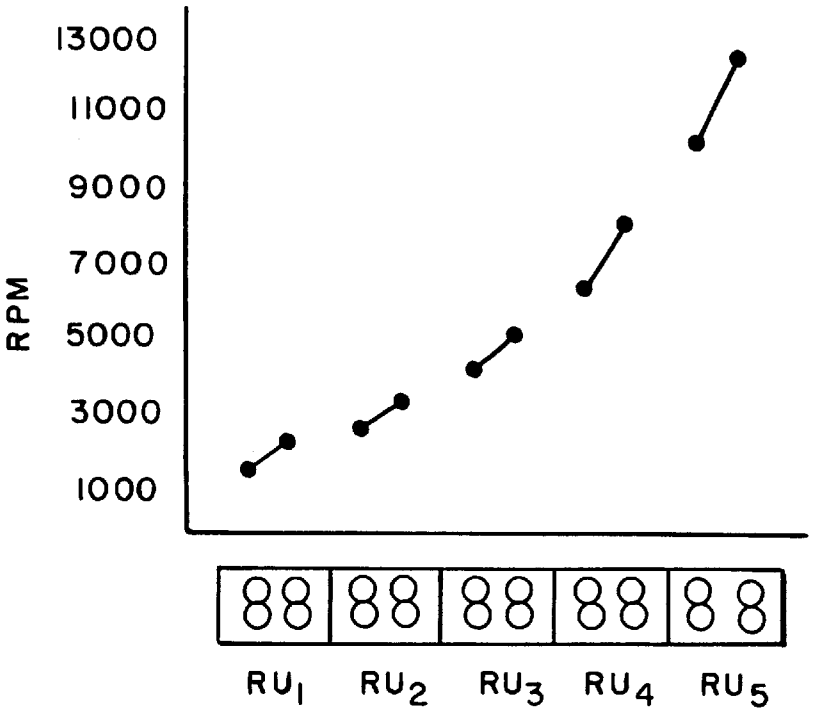
FIG. 3 PRIOR ART
FIG. 3 is a graph depicting the speed relationship between the successive roll pairs of the modular rolling mill depicted in FIG. 1.

The gear train of each gear unit is designed to accommodate operation of the next subsequent rolling unit at the speed of the dummied rolling unit. Thus, it will be seen by a comparison of FIGS. 3 and 6 that by introducing gear unit $GU_1$ in place of rolling unit $RU_2$, with an appropriate adjustment of the speeds of the drive motors 38, the rolling unit $RU_3$ can be operated at the speed of the dummied rolling unit $RU_2$. Likewise, the introduction of gear unit $GU_2$ enables the rolling unit $RU_5$ to be operated at the speed of the dummied rolling unit $RU_4$.

Figure 1:
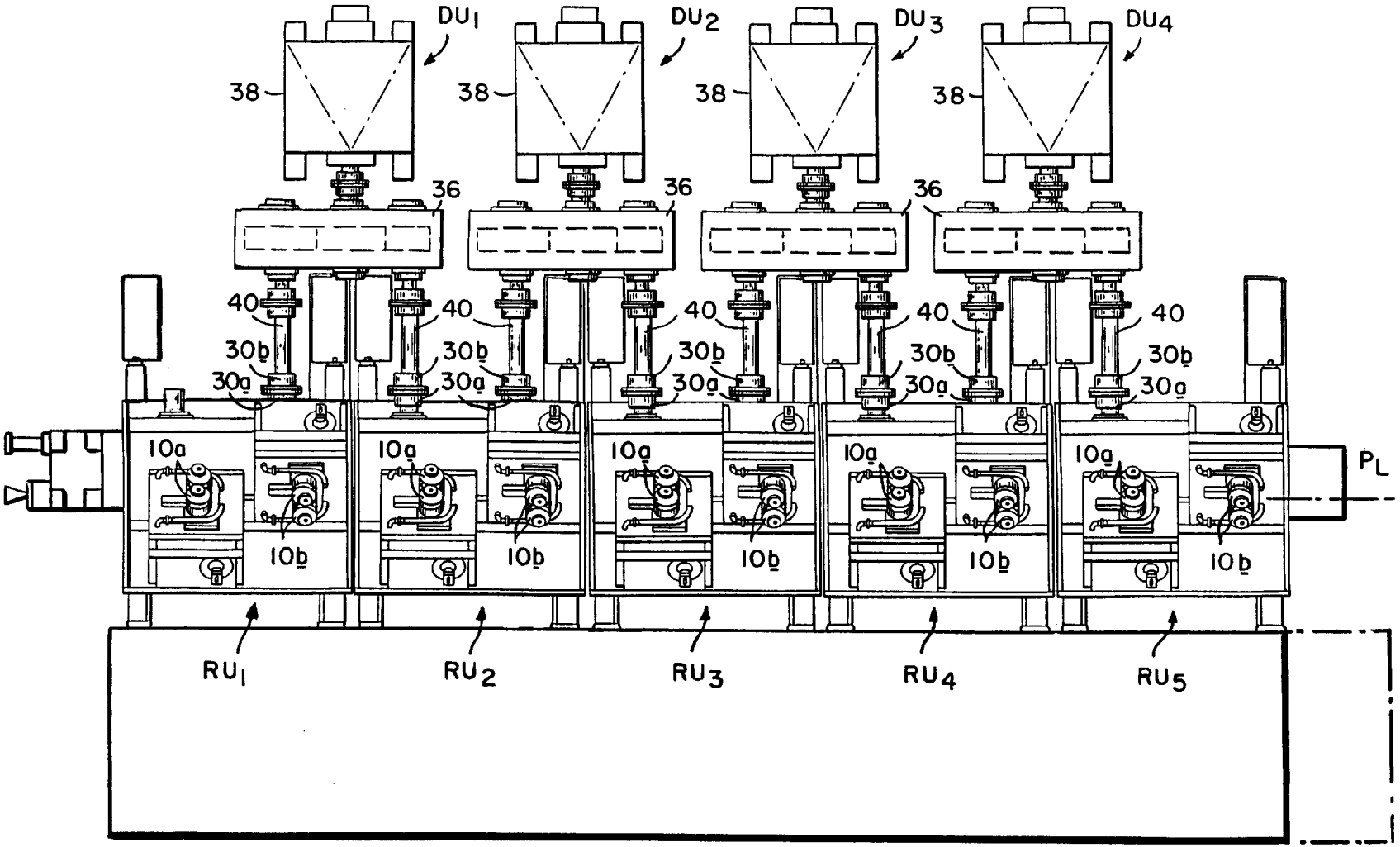
FIG. 1 PRIOR ART
FIG. 1 is a plan view of a known modular rolling mill.
Figure 2:
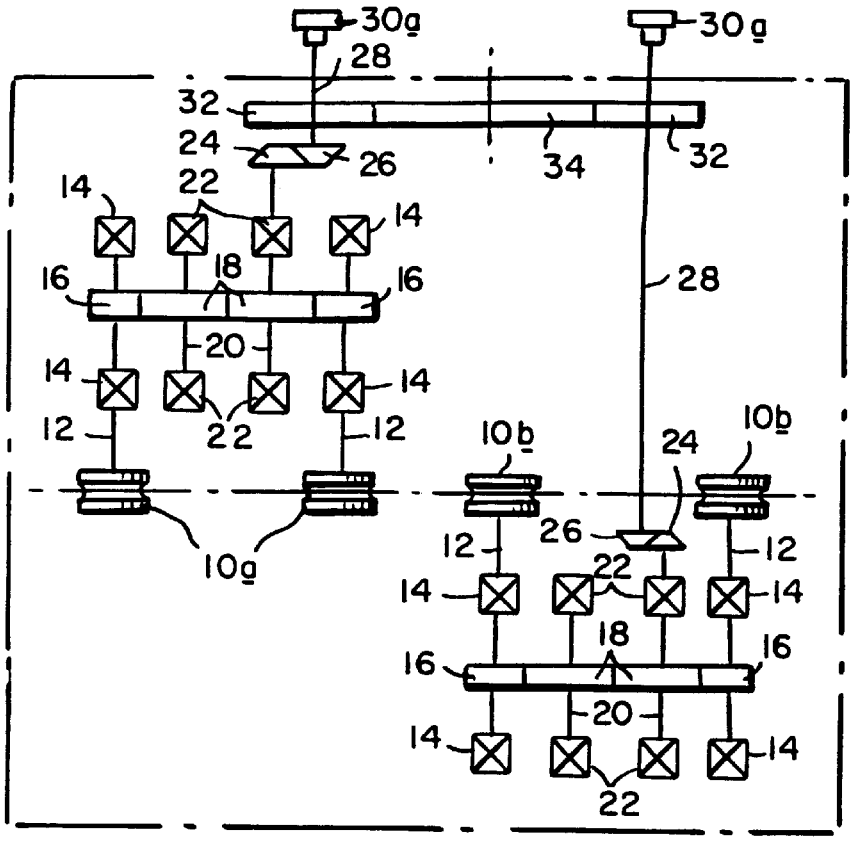
FIG. 2 PRIOR ART
FIG. 2 is a diagrammatic illustration of the internal drive components of a typical rolling unit.

As shown in FIG. 4, the gear units $GU_1$ and $GU_2$ are advantageously provided with water nozzles 54 and associated equalizing guide pipes 56 for cooling the product. The resulting temperature reduction between successive rolling units enables the more exotic products mentioned above to be rolled at higher speeds than would otherwise be possible with the continuous rolling sequence of the mill configuration depicted in FIG. 1. This result is achieved without interrupting the continuity of the mill drive train.

I claim:

1. In a modular rolling mill having at least three rolling units arranged in succession on a mill pass line, said rolling units having work roll pairs arranged successively to effect a rolling sequence on a product directed along said mill pass line, with a plurality of drive units arranged successively alongside said mill pass line, and with coupling means for providing a continuous drive train by connecting all but the first and last of said rolling units to two successive drive units and for connecting the first and last of said rolling units to the first and last of said drive units, said drive train being operative to drive the successive work roll pairs at progressively higher speeds, an apparatus for providing a gap in said rolling sequence without interrupting the continuity of said drive train, said apparatus comprising a gear unit constructed to be installed between two rolling units in a space created by the removal of another of said rolling units from said mill pass line, said gear unit being coupled to the drive units previously coupled to the removed rolling unit and being configured to accommodate operation of the next subsequent rolling unit at the speed of said removed rolling unit.

2. The apparatus as claimed in claim 1 wherein said gear unit further comprises means for cooling said product.

* * * * *